US007329367B2

(12) United States Patent
Elgarhy

(10) Patent No.: US 7,329,367 B2
(45) Date of Patent: Feb. 12, 2008

(54) ENHANCEMENT OF DURABLE SOIL RELEASE AND SOIL RESIST, STAIN RESIST WATER AND OIL REPELLENCY AND THE SOFTNESS OF FIBROUS SUBSTRATES, THE SUBSTRATES SO TREATED AND THE TREATING COMPOSITION

(75) Inventor: Yassin Elgarhy, St-Eustache (CA)

(73) Assignee: Trichromatic Carpet Inc., St. Eustache, Quebec (CA)

( * ) Notice: Subject to any disclaimer, the term of this patent is extended or adjusted under 35 U.S.C. 154(b) by 171 days.

(21) Appl. No.: 10/943,870

(22) Filed: Sep. 20, 2004

(65) Prior Publication Data

US 2006/0062968 A1 Mar. 23, 2006

(51) Int. Cl.

| | |
|---|---|
| ***D06M 15/256*** | (2006.01) |
| ***D06M 10/10*** | (2006.01) |
| ***D06M 17/00*** | (2006.01) |
| ***D06M 23/00*** | (2006.01) |
| ***D32B 5/00*** | (2006.01) |
| ***D32B 27/08*** | (2006.01) |
| ***D32B 27/12*** | (2006.01) |

(52) U.S. Cl. ..... 252/8.61; 252/8.62; 252/8.63; 427/393.4; 427/427.4; 427/430.1; 428/171; 428/364; 428/365; 442/79; 442/80; 442/82; 442/93; 442/94

(58) Field of Classification Search ..... 252/8.61, 252/8.62, 8.63; 427/393.4, 427.4, 430.1; 442/93, 94, 79, 80, 82; 428/171, 364, 365
See application file for complete search history.

(56) References Cited

U.S. PATENT DOCUMENTS

| | | | | |
|---|---|---|---|---|
| 3,949,124 | A | 4/1976 | Jilla et al. | |
| 3,959,230 | A | 5/1976 | Hays | |
| 3,962,152 | A | 6/1976 | Nicol | |
| 4,125,370 | A | 11/1978 | Nicol | |
| 4,504,401 | A | 3/1985 | Matsuo et al. | |
| 4,977,191 | A | 12/1990 | Saleman | |
| 5,252,375 | A | 10/1993 | Turbak et al. | |
| 5,401,553 | A | 3/1995 | Miwa et al. | |
| 6,048,941 | A | 4/2000 | Yamana et al. | |
| 6,458,443 | B2 | 10/2002 | Collier et al. | |
| 6,624,276 | B2 | 9/2003 | Lamers et al. | |
| 2005/0056805 | A1* | 3/2005 | Fang et al. | 252/8.62 |
| 2005/0062010 | A1* | 3/2005 | Fang et al. | 252/8.62 |

* cited by examiner

*Primary Examiner*—Anthony J. Green
(74) *Attorney, Agent, or Firm*—Ogilvy Renault

(57) ABSTRACT

A formulation comprising a fluorochemical, cross linking agent, a soil releasing agent, soil resisting agent and a stain resist agent, enhance the soil resist, soil release, stain resist, water and oil repellency and softness of fibrous substrate, the formulation may be applied in an aqueous composition, for example by foam application, spray or immersing in aqueous solution.

9 Claims, No Drawings

ENHANCEMENT OF DURABLE SOIL RELEASE AND SOIL RESIST, STAIN RESIST WATER AND OIL REPELLENCY AND THE SOFTNESS OF FIBROUS SUBSTRATES, THE SUBSTRATES SO TREATED AND THE TREATING COMPOSITION

BACKGROUND OF THE INVENTION a) Field of the Invention

This invention relates to a fibrous substrate, of natural or synthetic fibres having soil resistance, stain resistance, soil release, water and oil repellency and softness; to a method for imparting soil resist stain resist soil release, water and oil repellency, and softness to such a fibrous substrate; and to a formulation for enhancing soil resist, stain resist, soil release, water and oil repellency, and softness in such a fibrous substrate.

b) Description of Prior Art

Natural and synthetic fibrous substrate are employed in the manufacturing of indoor and outdoor textile products such as garments, sport cloth, carpets, curtains, table cloths, upholstery protectives, work wear and women's and men's outer wear. Such products are often required to be soil resistant, stainproof, stain resist, soil release, water and oil repellent, and in particular cases these fibrous products are required to be very soft. Also these fibrous substrates are normally required to be easy to clean and provide protection against rain and oil based stain.

U.S. Pat. No. 3,959,230 Hays: Hugh Robert

U.S. Pat. No. 4,125,370 Nicol, Charles H

U.S. Pat. No. 3,962,152 Nicol, Charles Henry and

U.S. Pat. No. 4,977,191 Saleman Robert K explain the use of terephtalate polymer in processes imparting improved soil release and cleaning properties to fabrics by treating such fabrics with an aqueous solution of terephthalate polymers U.S. Pat. No. 3,949,124 Jilla, et al explains the use of copolymers of dimethyl terephthalate, alkyl phenol and diisocyanate and polyethylene glycol or other poly alkylene glycol to enhance hydrophilic, soil repellency and anti-static properties in textile fibers.

U.S. Pat. No. 5,252,375 Turbak et al, explains the use of isocyanates to impart a permanent stain resistance to polyamide including nylon carpet.

U.S. Pat. No. 5,401,553 Miwa Masahiro et al, describes the use of blocked iasocyanates in a composition for carpet backings.

U.S. Pat. No. 6,624,276 Lamers et al describes a curable polyurethane, a coating prepared therefrom and a method of making the same.

U.S. Pat. No. 4,504,401 Matsuo et al describes a stain proofing agent containing as an active ingredient a polyfluoroalkyl compound and a process for its preparation.

U.S. Pat. No. 6,048,941 Yamana et al describes a stain proofing composition including fluoroalkyl groups, vinyl chloride and a crosslinking monomer.

Each of the Patents mentioned above, imparts different properties to fibrous substrates, but not necessarily all the properties required in a fibrous substrate.

SUMMARY OF THE INVENTION

It is an object of this invention to provide fibrous material that includes natural and synthetic substrates, with a durable soil release, and soil resist, stain resist, water and oil repellency and softness.

It is a further object of this invention to provide an aqueous formulation for providing soil release, soil resist, stain proof, stain resist, water and oil repellency and softness to fibrous substrates.

It is a still further object of this invention to provide a method of imparting soil release, soil resist, stain resist, water and oil repellency and softness to a fibrous substrate.

In accordance with one aspect of this invention there is provided a fibrous substrate having durable soil release, soil resist, stain resist, water and oil repellency and softness, the fibrous substrate having applied thereto a combination of:

a. an anionic or non ionic fluorochemical, b. a crosslinking agent, c. a soil release agent, d. a soil resist agent, and e. a stain resist agent.

The soil releasing agent may suitably be selected from the group consisting of polyesters, sulfonated polyesters, polyamines or polyacrylates.

The soil resisting agent may suitably be selected from the group consisting of polyacrylate, amorphous silica, polyacrylamide and polyurethane.

The water and oil repellent and the stain proofing agent are suitably selected from the group consisting of water based anionic or non-ionic fluorochemicals.

The crosslinking agent to increase the durability is suitably selected from the group consisting of blocked isocyanates, acrylates or styrene/acrylates, oxazolines and aziridine polymers or copolymers.

The stain resisting agent is suitably selected from the group consisting of sulfonated or partially sulfonated aromatic condensation products, methacrylic acid polymers or copolymers and styrene or maleic anhydride polymers or copolymer. In particular, a sulfonated aromatic condensation product of the novolak or resole type or naphthalene condensate type, in combination with a polymer or copolymer of methacrylic acid, acrylic acid, butyl acrylate, ethyl acrylate, 2-ethyl hexyl acrylate or 2-ethyl hexylmethacrylate.

In accordance with another aspect of the invention there is provided a method of imparting durable soil release, soil resist, stainresist, water and oil repellency and softness, to a fibrous substrate comprising contacting the fibrous substrate with a formulation comprising a soil release agent, a soil resist agent, a stain resist agent, a fluorochemical, and a crosslinking agent.

In accordance with another aspect of the invention there is provided an aqueous formulation for providing durable soil release, soil resist, stain proof stain resist and water and oil repellency, comprising in an aqueous vehicle, a soil release agent, a soil resist agent, a stain resist agent, a water and oil repellent fluorochemical and a crosslinking agent.

DETAILED DESCRIPTION OF THE INVENTION

1-Fluorochemicals

The invention employs fluorochemicals in its complex, the fluorochemicals are in particular, water based fluorochemicals, and can be anionic or non ionic fluoroalkyl acrylate copolymers, fluorocarbon polymers or fluoroacrylate polymers and may be employed in emulsion or dispersion form, they may be employed in conjunction with emulsifiers and surfactants.

Fluorochemicals having soil release properties usually contain polyester polymer, polyamines or polyacrylate polymers. Fluorochemicals usually contain, but are not limited to, polyacrylate polymers amorphous silica, polyacryamides and polyurethanes.

2-Crosslinking Agent

The crosslinkers which can be used in this invention in particular are, styrene-acrylates, oxazolines or aziridine polymers or copolymers and preferably are blocked isocyanates because they provide softer handle in the substrate. Examples of blocked isocyanates axe described in U.S. Pat. Nos. 5,401,553 and 6,624,776.

The blocked polyisocyanates include, for example, aliphatic polyisocyanates such as ethylene diisocyanate, tetramethylenediisocyanate, hexamethylene diisocyanate, 2,4,4- or 2,2,4-dimethylhexamethylene diisocyanate or methyl 2,6-diisocyanatocaproate; alicyclic disocyanates, such as 3-isocyanatomethyl-3,5,5-trimethylcyclohexane, 1,3- or 1,4-bis(isocyanatomethyl) cyclohexane, methylcyclohexane 2,4- or 2,6-diisocyanate, dicyclohexylmethane-4,4-diisocyanate or 1,3-or 1,4-diisocyanatocyclohexane, aromatic diisocyanates, such as m-or phenylene diisocyanate, mixtures of these, diphenylmethane-4,4-diisocyanate, 2,4- or 2,6-tolylene diisocyanate or mixtures of these; and aromatic-aliphatic diisocyanates, such as 1,3-or 1,4-is(isocyanatomethyl benzene or 1,3- or 1,4-bis (alpha-isocyanatopropyl) benzene.

The polyisocyanates may be triisocyanates, such as triphenyl methane-4,4,4-triisocyanate, 1,3,5-triisocyanatobenzene, 1,3,5-tris(isocyanatomethyl)cyclohexane, 1,3,5-tris (isocyanatomethyl)-benzene or 2-isocyanatoethyl 2,6-diisocyanatocaproate Other polyisocyanates are also usable to form the blocked polyisocyanate, such as polymeric polyisocyanates, e.g. dimmers or trimers of diisocyanates, polymethylene polyphenylene polyisocyanates, various isocyanate terminated prepolymers which are obtainable by the reaction of polyisocyanates in excess and active hydrogen containing compounds, biuret derivatives or allophanate derivatives of polyisocyanates. These compounds may be used singly or as a mixture.

The active hydrogen containing compound usable is exemplified by low molecular weight compounds such as ethylene glycol, propylene glycol, diethylene glycol, dipropylene glycol, triethylene glycol, 2,2,4-trimethyl-1,3-pentanediol, neopentyl glycol, hexanediol, cyclohexanedimethanol, cyclohexanediol, hydrogenated bisphenol A, xylylene glycol, glycerine, trimethylol ethane, trimethylol propane, hexanetriol, pentaerythritol, sorbitol, sucrose castor oil, ethylenediamine, hexamethylenediamine, ethanolamine, triethanolamine, water, ammonia or urea, and a variety of high molecular weight compounds, such as polyether polyol, polyester polyol, acrylic polyol or epoxy polyol.

The blocking agent usable includes, for example, phenol-type blocking agents such as phenol, cresol, p-nonylphenol or hydroxybenzoic acid ester lactam-type blocking agents such as epsilon-caprolactam or gamma-butyrolactam, active methylene-type blocking agents such as diethyl malonate, methyl acetoacetate or acetylacetone; alcohol-type blocking agents such as ethanol, isopropyl alcohol, t-butyl alcohol, lauryl alcohol, ethylene glycol- monoethyl ether, benzyl alcohol, glycolic acid, glycolates such as methyl glycolate, ethyl glycolate or butyl glycolate or butyl glycolate, lactic acid, lactic acid esters such as methyl lactate, ethyl lactate or butyl lactate, diacetone alcohol or ethylene chlorohydrin; mercaptan-type blocking agents such as butyl mercaptan, octyl mercaptan, t-dodecyl mercaptan, 2-mercaptobenzothiazole or thiophenol; acid amide-type blocking agents such as acetanilide, acetamide, acrylamide or benzamide, imido-type blocking agents such as succinimide or phthalimide; amine-type blocking agents such as diphenylamine, ccarbazole, aniline, dibutylammine; iimddazole-type blocking agents such as imidazole or 2- ethylimidazole; urea-type blocking agents such as urea, thiourea, ethylene thiourea, carbamate-type blocking agents such as 2-oxazzolidone, phenyl N-phenyl carbamate; oxime-type blocking a gents such as formaldoxime, acetaldoxime, acetoxime, methyl ethyl ketoxime, diacetyl monoxime, cyclohexanone oxime or benzophenone oxime, and sulfite-type blocking agents such as sodium bisulphite or potassium bisulphite.

3-Soil Release

The soil releasing agents employed in the invention are typically of the polyester, sulfonated polyester, polyamine or polyacrylate type. The polyester-type includes homopolyesters or copolyester, and usually comprises an acid residue and a glycol residue and they are soluble and or dispersable terephtalate based polyesters or copolyester.

Another type of soil release for fabric or carpet is water soluble or water dispersible and curable sulfonated polyester resins, the resins are reaction products of polyterephthalate, sulfoisophthalate, polyols, polyacids, and acids and crosslinking agents, a good example of such product is described in U.S. Pat. No. 5,820,982. Another type of soil release referred to herein useful as soil release for polyamide and cotton fibers is polyamines having functionalised backbone moieties. Examples of such products are described in U.S. Pat. No. 6,191,093.

Another type of soil releasing agent suitable for polyamide and cotton fibres is the polyacrylate type of product, preferably based on methylmethacrylate and ethyl acrylate, usually produced as emulsions. Also methacrylic acid, 2-ethyl hexyl methacrylate, butyl acrylate, methyl acrylate, 2-ethylhexylacrylate, polyurethane and polyacrylamide can be useful.

Soil Resist

The soil resists employed in this invention include acrylic, methacrylic and methyl methacrylate polymers or copolymers, preferably of high molecular weight; also polyurethanes or amorphous silica can be useful. In particular there may be mentioned polymers and copolymers of two or more of acrylates, methacrylic acid, methylmetharylate, ethyl acrylate, 2-ethylhexylmethacrylate, 2-ethylhexylacrylate.

Stain Resist

In the case of wool or polyamide fibers stain resisting agents can be used in the formulation as a separate addition in the finishing bath or in an all in one product. The stain resist usually is a sulfonated or partially sulfonated aromatic condensation product of the novolak or resol type or a naphthalene resin. Examples of these products are described in U.S. Pat. No. 5,736,468 which describes the manufacturing of resole resins. U.S. Pat. No. 3,467,486 and U.S. Pat. No. 3,790,334 describe the manufacturing of naphthalene condensation products. U.S. Pat. No. 5,098,774 and U.S. Pat. No. 6,395,655 provide details about the manufacturing of the condensation product of 4,4-dihydroxy di-phenol sulfone and the sulfonated di-hydroxy diphenol sulfone. U.S. Pat. No. 4,592,940 provides details on the sulfonated phenolformaldehyde condensation products with dihydroxy diphenol sulfone.

The enhancement of the durable soil release, soil resist, stain proof, water and oil repellency can be achieved by adding in a formulated all in one product and added as one addition to the bath for a one step application.

An amount of at least 0.01% by weight, of each ingredient, should be deposited on the fibre substrate, based on the weight of the substrate.

The amount of the suitable durable soil release, soil resist, fluorochemical and the crosslinking agent of this invention deposited from the aqueous formulation on the fibrous substrate is dependent on the process employed for the deposition, as is well understood by persons in the art and these persons in the art will well understand the concentration required in the aqueous formulation based on the application technique and method parameters employed, in order to provide a desired amount on the substrate.

The aqueous formulation may be applied to the fibrous substrate by conventional procedures for example, the substrate may be immersed in a bath of aqueous formulation, or the formulation may be exhausted onto the substrate by a foam system or spray application; the treated substrate is dried and cured, after the application.

The treated substrate retains the deposited polymers, on the fibers. In a particular embodiment there is a deposit of the formulation product of the invention of each of the fluorochemical, soil release agent, soil resist agent, stain resist and cross linker, in an amount of at least 0.1% based on the weight of the substrate, suitably the product of this invention is deposited from an aqueous vehicle at an acidic pH below 7.

A major problem with this kind of formulation is the stability or the compatibility of all the ingredients together.

Important attention should be given to these formulations. The ingredients should suitably be added in a certain order to disperse or solubilize every ingredient in the previous one, in order. Also it is found that to ensure the stability of the finished product, an addition of condensated diphenyoxide disulfonate stabilizes the product especially in the presence of a small amount of citric acid to reach a pH of 7 or lower. The ingredients should suitably be mixed at temperatures lower than 25° C. (77° F.). It is within the skill of person in the art to determine by experiment an appropriate sequence of dispersing or solubilizing the ingredients, for specific ingredients within the scope of the invention.

DESCRIPTION OF PREFERRED EMBODIMENTS

The enhancement of the durable soil release, soil resist, water and oil repellency, stain resist stain proof and the softness can be achieved by adding the formulated product of the invention in an aqueous bath, containing all the ingredients needed to facilitate the handling of the ingredients of the application and reduce the weighing errors and shorten the time of addition.

In this case a balanced formulation containing the ingredients required can be made based upon the quality needed from the fibrous substrate as follows:

FORMULATION EXAMPLES

Example F1

An all in one product suitable for polyester and polyester cotton blends, soil release water and oil repellent, soil resist, stain resist can be made as follows, in parts by weight:

50 fluorochemical
15 soil release polyester based on terephtalate
15 soil release based on polyamine
8 blocked isocyanate
4 amorphous silica
3 condensated diphenyloxide disulfonate
5 water
Total 100

Example F2

An all in one product for polyamide fibres can be formulated as follows, in parts by weight, to provide protection against staining, with soil resist, soil release, water and oil repellency with high durability.

50 fluorochemnical
15 polyamide as soil release agent
8 aromatic condensation product
15 copolymer of methacrylic acid of high molecular weight
8 blocked isocyanate
2.5 condensated condensated diphenyl oxide disulfonate
1 citric acid 50% liquid
0.5 antioxidant
Total 100

Example F3

An all in one product suitable for polypropylene fibres as water/oil repellent soil resist—stain resist can be made as follows, in parts by weight:

50 fluorochemical
26 high molecular weight methacrylic acid copolymer
8 blocked isocyanate
5 amorphous silica
3 condensated diphenyl oxide disulfonate
1 citric acid 50%
Total 100

Example F4

All in one product suitable for polyamide fibers especially for carpet, can be formulated as follows to provide antistain, soil release, soil resist, water & oil repellency with high durability.

50 Fluorochemical
20 sulfonated polyesters
10 methacrylic acid copolymer
8 Aromatic condensation product
8 blocked isocyanate
1 citric acid 50% liq.
0.5 antioxidant
2.5 sodium alphaolefin sulfonate
Total 100

Test Methods

In the test procedures and examples described below all percentages are by weight unless otherwise indicated.

Water Repellency Drop Test (Dupont Test)

| COMPOSITION | | |
|---|---|---|
| WATER | IPA | RATING |
| 98 | 2 | 1 |
| 95 | 5 | 2 |
| 90 | 10 | 3 |
| 80 | 20 | 4 |
| 70 | 30 | 5 |
| 60 | 40 | 6 |

Oil Repellency Test AATCC Test Method 118-1997

| COMPOSITION | RATING |
|---|---|
| Kaydol (mineral oil) | 1 |
| 65/35 Kaydol/N-hexadecane | 2 |
| N-hexadecane | 3 |
| N-Tetradecane | 4 |
| N-Dodecane | 5 |
| Decane | 6 |
| N-Octane | 7 |
| N-Heptane | 8 |

Testing Procedure

Beginning with the lowest numbered test liquid carefully place one drop in several locations on the surface. Repeat with higher number liquids until the highest number is reached that does not wet the surface in 30 seconds (oil) or 10 seconds (water)

Carpet Soiling

1) The soil release test is the carpet soiling visual rating method of the AATCC Test Method 121-1995
2) Soil release test, for oily stain release method, were evaluated according to the following:
   1. Place a test piece (6.5×7 cm) on a filter paper.
   2. Place a drop of stain on the test piece.
   3. Place a plastic sheet on stain and place 500 g weight for 60 seconds.
   4. Remove weigh and hold the test piece for 24 hour before laundering.
   5. Laundering the test piece. (5min at 40° C.)
   6. Watch the trace of stain on the test piece. And evaluate at a rate of 105. Grade 5 represents the best stain removal and grade 1 the poorest stain removal.
3) Stain resistance test: AATCC Test method 175-1998 The degree of staining is evaluated by the AATCC red 40 stain scale from 1 to 10, rating of 10 is excellent rating of 1 is very poor.

After Wet Cleaning Stain Resistance (WS)

The sample to be tested is first immersed in a detergent solution containing 15 grams of Duponol Waqe (Trade Mark of E.I. DuPont de Nemours a surface active agent based on lauryl sulfate) per liter of water at a pH of 10 and at 20° C. for 15 minutes. The sample is removed from the detergent solution and rinsed thoroughly with cool tap water and dried. The staining solution is then applied and evaluated as set out in the initial stain resistance procedure AATCC 175-1998.

Discoloration Upon Exposure to Light (LD)

In the examples a graduated scale from 1 to 5 was used to evaluate discoloration upon exposure to light where 5 represents no discoloration. 4 represents acceptable discoloration and 3 or less represents unacceptable discoloration. Exposure to light was carried out according to AATCC test method 16-1998 with an exposure time of 40 standard hours.

EXAMPLES

1. Product suitable for polyester/cellulosic fibers: This formulated all in one product was applied on 50/50 polyester cotton as soil release oil repellent protection with high durability to wet cleaning as follows:

a. A piece of 50/50 polyester/cotton woven fabric was padded in solution containing 150 g/l product of Example F1 and the pad pick-up was 70% on weight of substrate. The padding was followed by drying at 100° C. then curing at 160° C. for 60 seconds.

b. b. A comparison test was done with conventional soil release fluorochemical as follows:

1) 75 g/L soil release fluorochemical 100 g/L glyoxal resin 30 g/L catalyst

The substrate was padded with 70% pick-up followed by drying and curing as the same previous procedure.

The evaluation was made as follows:

The oil repellency test results were evaluated according to AATCC Test Method 118-1997:

| Oil Repellency | Treated fabric not washed | After 5 home laundering |
|---|---|---|
| Ex. F1 recipe | 6 | 5 |
| Conventional recipe | 5 | 3 |

1 home laundering = 5 mins. At 40° C., continuous laundering

It was noticable that the fabric treated with the Ex. F1 recipe was very soft and the opposite was the case with the fabric treated with the conventional recipe and the glyoxal resin which was very stiff.

The stain release property (stain: dirty motor oil) were evaluated according to the test method described earlier (Soil Release: Oil stain release)

| | Treated fabric not washed | After 5 home laundering |
|---|---|---|
| Ex. F2 recipe | 5 | 4 |
| Conventional recipe | 4 | 2 |

2) Product suitable for Nylon and wool fibers, and their blends as durable oily stain release water oil repellency, soil resist and stain resist: A piece of Nylon 6 was treated with the product of Ex. F2 of this invention as follows:

20 g/L Product of Ex. F2

3 g/L foaming agent based on fatty amide and other surfactants balance water

The solution was foamed and applied on a carpet substrate with a pick-up of 15% and the penetration was 30% on the pile of the carpet.

In the same manner was applied the following:

100 g/L non ionic fluorochemical contains (8% fluoropolymer)

80 g/L stain blocker 30% solid novolak resin

The evaluation was made as follows:

Water Repellency

| | Treated carpet not washed | After alkaline wash |
|---|---|---|
| Ex. F2 recipe | 6 | 5 |
| Conventional recipe | 6 | 4 |

Oil Repellency

| | Treated carpet not washed | After alkaline wash |
|---|---|---|
| Ex. F2 recipe | 5 | 4 |
| Conventional recipe | 5 | 2 |

The Stain Release Property (Stain: Dirty Motor Oil)

| | Treated carpet not washed | After alkaline wash |
|---|---|---|
| Ex. F2 recipe | 5 | 4 |
| Conventional recipe | 5 | 2 |

Stain Resist Evaluation:

| | Treated carpet not washed | After alkaline wash |
|---|---|---|
| Ex, F2 recipe | 9 | 7 |
| Conventional recipe | 7 | 6 |

Light Fastness:

Treated substrates were exposed to light for 40 hrs in a carbon arc machine and evaluated according to AATCC Test Method 16-1998; results:

| | 40 hrs exposure | |
|---|---|---|
| Ex. F2 recipe | L5 | No discoloration |
| Conventional recipe | L3 | Unacceptable discoloration |

3) Product suitable for polypropylene and polyamide fibers as water/oil repellent and soil resist. Comparison between the product of Ex. F3 and conventional fluorochemical was made as follows:

a. 100 g/L product of Ex. F3 was sprayed on polypropylene carpet substrate

Another polypropylene carpet substrate was sprayed with 50 g/L of the same fluorochemical used in the product of Ex. F3

The spray pick up was 15% on weight of substrate

The carpet substrate was dryed and then cured at 130° C. for 45 seconds. Evaluation of water/oil repellency and soil resist were evaluated as follows:

Water Repellency:

| | Treated carpet not washed | After washing |
|---|---|---|
| Ex. F3 recipe | 6 | 5 |
| Fluorochemical only | 6 | 4 |

Oil Repellency:

| | Treated carpet not washed | After washing |
|---|---|---|
| Ex. F3 recipe | 6 | 5 |
| Fluorochemical only | 6 | 3 |

Soil Resist Evaluation:

The carpet soiling on the same substrate treated with the product of Ex. F3, were tested by AATCC Test method 123-1995 and evaluated by AATCC 121 carpet soiling visual rating on the gray scale 5 is excellent, 1 is very poor. Results were as follow:

| | Rating after carpet soiling | Rating after carpet soiling and vacuumed |
|---|---|---|
| Ex. F3 recipe | 4 | 5 |
| Fluorochemical only | 2 | 2 |

4) Product suitable for polyamide fibers especially carpet as durable water/oil repellent stain resist, soil resist, stain resist, a piece of nylon 6 carpet was treated with the product F4 of this invention as follows:

200 g/L F4

800 g/L water

The solution was foamed as Ex F2 and applied on the carpet substrate with pick up of 15% and the penetration was 30% on the pile of the carpet.

In the same manner was applied the following:

100 g/L non-ionic fluorochemical contains (8% fluoropolymer)

80 g/L stainblocker 30% solid novolak resin the evaluation was made as follows:

Water Repellency

| | Treated carpet not washed | After alkaline wash |
|---|---|---|
| Ex. F4 | 6 | 5 |
| Conventional recipe | 6 | 5 |

Oil Repellency

| | Treated carpet not washed | After alkaline wash |
|---|---|---|
| Ex. F4 | 5 | 4 |
| Conventional recipe | 5 | 2 |

The Stain Release Property (Stain: Dirty Motor Oil)

| | Treated carpet not washed | After alkaline wash |
|---|---|---|
| Ex. F4 | 5 | 4-5 |
| Conventional recipe | 5 | 2 |

Stain Resist Evaluation:

| | Treated carpet not washed | After alkaline wash |
|---|---|---|
| Ex. F4 | 9-10 | 8 |
| Conventional recipe | 7 | 6 |

Light Fastness:

Treated

Substrates were exposed to light 40 hrs in carbon arc machine and evaluated according to AATCC Test Method 16-1998 results:

| 40 hrs exposure | | |
|---|---|---|
| Ex. F4 | L5 | No discoloration |
| Conventional recipe | L3 | Unacceptable discoloration |

The invention claimed is:

1. A fibrous substrate having durable soil release, soil resist, stain resist, water and oil repellency and softness, the fibrous substrate having applied thereto a combination of five different components a), b), c), d) and e), in weight % based on the weight of the fibrous substrate:

a. at least 0.01% of an anionic or non ionic fluorochemical to provide water and oil repellency, said fluorochemical being derived from an anionic or non ionic emulsion or dispersion of a fluoroalkyl acrylate copolyrner, fluorocarbon polymer or fluoroacrylate copolymer;

b. at least 0.01% of a crosslinking agent to provide durability in the substrate, said crosslinking agent being a blocked isocyanate, oxazoline, styrene-acrylate, or aziridine polymer or copolymer;

c. at least 0.01% of a soil release agent to provide soil release in the substrate, said soil release agent being a polyacrylate emulsion based on a copolymer comprising methylmethacrylate and ethyl acrylate;

d. at least 0.01% of a soil resist agent to provide soil resistance in the substrate, said soil resist agent being a polymer of methacrylic acid or acrylic acid, and e. at least 0.01% of a stain resist agent, said stain resist agent comprising a sulfonated aromatic condensation resin selected from the group consisting of novolak, resole and naphthalene condensation resins.

2. A substrate according to claim 1 wherein said combination further includes at least one of a solubilizer, an emulsifier and a penetrant.

3. A substrate according to claim 2 wherein said solubilizers, emulsifiers and penetrants are based on alcohols, ethoxylated surfactants, sulfonated surfactants, fatty acids, fatty amides, ethoxylated alcohols, ethoxylated fatty acids or amides and sulfonated aromatic condensates.

4. A formulation for providing durable soil release, soil resist, stain resist, water and oil repellency and softness in a fibrous substrate comprising five different components i), ii), iii), iv) and v), i) an anionic or non ionic fluorochemical to provide water and oil repellency, said fluorochemical being derived from an anionic or non ionic emulsion or dispersion of a fluoroalkyl acrylate copolymer, fluorocarbon polymer or fluoroacrylate copolymer;

ii) a crosslinking agent to provide durability, said crosslinking agent being a blocked isocyanate, oxazoline, styrene-acrylate, or aziridine polymer or copolymer;

iii) a soil release agent to provide soil release, said soil release agent being a polyacrylate emulsion based on a copolyrner comprising methylmethacrylate and ethyl acrylate;

iv) a soil resist agent to provide soil resistance, said soil resist agent being a polymer of methacrylic acid or acrylic acid, and v) a stain blocker resist agent to provide stain resistance, said stain blocker resist agent comprising a sulfonated aromatic condensation resin selected from the group consisting of novolak, resole and naphthalene condensation resins;

in an aqueous vehicle, said formulation containing each of i), ii), iii), iv) and v) in an amount to deposit at least 0.01% by weight of each on the fibrous substrate, based on the weight of fibrous substrate.

5. A formulation according to claim 4 further containing at least one of a solubilizer, an emulsifier and a penetrant.

6. A method of imparting durable soil release, soil resist, stain resist, water and oil repellency and softness, to a fibrous substrate comprising contacting the fibrous substrate with a formulation comprising five different ingredients, namely: a soil release agent to provide soil release in the substrate; said soil release agent being a polyacrylate emulsion based on a copolymer comprising methylmethacrylate and ethyl acrylate; a soil resist agent to provide soil resistance in the substrate; said soil resist agent being a polymer of methacrylic acid or acrylic acid; a stain resist agent to provide stain resistance in the substrate; said stain resist agent comprising a sulfonated aromatic condensation resin selected from the group consisting of novolak, resole and naphthalene condensation resins; a fluorochemical to provide oil and water repellency in the substrate, said fluorochemical being derived from an anionic or non-ionic emulsion or dispersion of a fluoroalkyl acrylate copolymer, fluorocarbon polymer of fluoroacrylate copolymer; and a crosslinking agent to provide durability, said crosslinking agent being a blocked isocyanate, oxazoline, styrene-acrylate, or aziridine polymer or copolymer; and depositing at least 0.01% by weight of each ingredient of the formulation on the substrate.

7. A method according to claim 6 wherein said formulation is an all in one formulation.

8. A method according to claim 6 wherein said substrate is immersed in an aqueous solution of the formulation, sprayed or foamed to the substrate.

9. A method according to claim 8 wherein said aqueous solution has a pH below 7.

* * * * *